US005437502A

United States Patent [19]

Warnick et al.

[11] Patent Number: 5,437,502

[45] Date of Patent: Aug. 1, 1995

[54] UTILITY HOLDER

[76] Inventors: John D. Warnick, R.R.1 Box 149, White Heath, Ill. 61884; Steve B. Hanners, R.R. 3 Box 310, Decatur, Ill. 62526

[21] Appl. No.: 283,178

[22] Filed: Aug. 3, 1994

[51] Int. Cl.[6] ..... A47B 81/00

[52] U.S. Cl. ..... 312/244; 312/284; 312/249.11; 312/286; 312/902; 211/70.6; 211/94; 211/193

[58] Field of Search ..... 312/284, 244, 249.8, 312/249.11, 902; 211/70.6, 94, 193; 248/210, 214, 223.4, 224.2, 225.1, 238

[56] References Cited

U.S. PATENT DOCUMENTS

| | | | |
|---|---|---|---|
| D. 303,306 | 9/1989 | Briscoe . | |
| 3,000,684 | 9/1961 | Shelly | 248/214 |
| 3,002,630 | 10/1961 | Heisser | 248/224.2 X |
| 3,542,446 | 11/1970 | Joyce | 312/244 |
| 3,734,526 | 5/1973 | Propst et al. . | |
| 4,222,544 | 9/1980 | Crowder | 248/224.2 X |
| 4,240,684 | 12/1980 | Henning | 312/284 X |
| 4,429,850 | 2/1984 | Weber et al. | 211/193 X |
| 4,457,527 | 7/1984 | Lowery . | |
| 4,458,963 | 7/1984 | Keddie | 312/902 X |
| 4,509,648 | 4/1985 | Govang et al. | 211/70.6 |
| 4,653,638 | 3/1987 | Lackner et al. | 312/902 X |
| 4,681,233 | 7/1987 | Roth | 211/70.6 |
| 4,706,918 | 11/1987 | Wilson | 248/210 |
| 4,744,613 | 5/1988 | Brantingham et al. | 312/284 X |
| 4,880,192 | 11/1989 | Vom Brauke et al. | 211/70.6 X |
| 5,188,242 | 2/1993 | Smith | 211/70.6 X |
| 5,246,286 | 9/1993 | Huebschen et al. . | |
| 5,360,121 | 11/1994 | Sothman | 211/94 X |
| 5,370,263 | 12/1994 | Brown | 248/210 X |
| 7,209,098 | 6/1980 | Adams | 211/94 X |

FOREIGN PATENT DOCUMENTS 2171079 8/1986 United Kingdom .

*Primary Examiner*—Laurie K. Cranmer
*Assistant Examiner*—Rodney B. White
*Attorney, Agent, or Firm*—Richard C. Litman

[57] ABSTRACT

A utility holder for storing and carrying a plurality of tools and the like. In the preferred embodiment, the utility holder includes a frame having a plurality of compartments. Removably stored within these compartments is a plurality of drawers for receiving the tools and other articles to be stored. A jacket substantially covers, and is removable from, the frame. This jacket is configured to form a cavity for placement upon the apex of a ladder or similar structure. The exterior surface of the jacket is mateable with each of the drawers. When the jacket is placed upon the apex of a ladder or similar structure, there is minimal danger that the jacket and the tools can fall to the ground. For further safety and convenience, a plurality of tool holders are attachable to the hanging device so that individual tools may be displayed and accessed.

13 Claims, 8 Drawing Sheets

UTILITY HOLDER

BACKGROUND OF THE INVENTION

1. Field of the Invention

The present invention relates to a utility holder for storing and displaying a plurality of tools and the like. More particularly, the present invention relates to a utility holder having drawers and individual tool holders that can be secured either internally for storage or externally for display.

2. Description of the Prior Art

Prior tool holders and the like have been provided in a number of shapes and sizes, and have also been provided with easy to access receptacles. In U.S. Pat. No. 3,734,526 issued to Robert L. Propst et al. on May 22, 1973, there is disclosed a cart having a wheeled base and an upstanding back affixable to a drawer supporting frame. A hanger is affixed to the drawer supporting frame, and is engagable with a rail projecting upwardly and outwardly from the upstanding back. This hanger is configured as a hook for seating inside a slot extending substantially the length of the rail. When the hanger is disposed within the slot, the drawer supporting frame is secured to the upstanding back, and a plurality of drawers can be stored within the drawer supporting frame.

Another patent showing the use of removable storage devices is U.S. Pat. No. 4,457,527 issued to A. J. Lowery on July 3, 1984. This patent illustrates a two wheeled utility cart having a back plate and a pair of side plates, all of which have a plurality of retainers integral therewith. These retainers are flanges adapted to receive lips affixed to various storage devices, such as bins and looped tool holders. In one embodiment of the invention, a hinged cover may be secured across the side plates.

Other devices for storing tools and the like are disclosed in U.S. Pat. No. 5,246,286 issued to David A. Huebschen et al. on Sept. 21, 1993, U.S. Des. Pat. No. 303,306, issued to Jewel J. Briscoe on Sep. 5, 1989, and British Pat. No. 2 171 079 issued to Gerald Alexander Legg on Aug. 20, 1986. The Huebschen et al. patent discloses a tool cabinet formed without the use of fasteners or weldments. Neighboring panel sections are attached to each other by a plurality of interfitting flanges secured to each panel. When the individual panel sections are attached, the resultant structure is an open-front housing. Secured to this open front housing are three continuous frame members utilized to support a plurality of drawer assemblies.

The Briscoe patent shows a trash container cart having a plurality of receptacles attached externally to one of the sides of the container.

The Legg patent illustrates a two part reversible tool case interchangeable between a closed position and an open position. A hinge connects the two parts, and a plurality of tool retaining brackets are secured to opposing side walls of the case. These brackets are accessible when the case is in the open position, but they are internal to the case when it is in the closed position.

None of the above inventions and patents, taken either singly or in combination, is seen to describe the instant invention as claimed.

SUMMARY OF THE INVENTION

The present invention is a utility holder for storing and carrying a plurality of tools and the like. In the preferred embodiment, the utility holder includes a frame having a plurality of compartments. Removably stored within these compartments is a plurality of drawers for receiving the tools and similar articles. A jacket substantially covers the frame, and a carrying handle extends outward from the frame, through an aperture in the jacket.

The jacket is separable from the frame, and it is configured to form a cavity for placement upon the apex of a ladder or similar structure. The exterior surface of the jacket includes a hanging device configured to mate with an attachment mechanism on each of the drawers. The contents of the drawers, therefore, can be displayed by securing the drawers to the exterior surface of the jacket. When the jacket is placed upon the apex of a ladder or similar structure, there is minimal danger that the jacket and the tools can fall to the ground. For further safety and convenience, a plurality of tool holders are attachable to the hanging device so that individual tools may be displayed and accessed.

Accordingly, it is a principal object of the invention to provide a novel utility holder for conveniently storing and carrying a plurality of tools and the like.

It is another object of the invention to provide a novel utility holder capable of internally receiving a plurality of drawers.

It is a further object of the invention to provide a novel utility holder having a removable jacket with a hanging device configured to mate with each of the drawers to secure the drawers in a display position.

Still another object of the invention is to provide a novel utility holder having a removable jacket configured to securely rest upon the apex of a ladder or the like.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
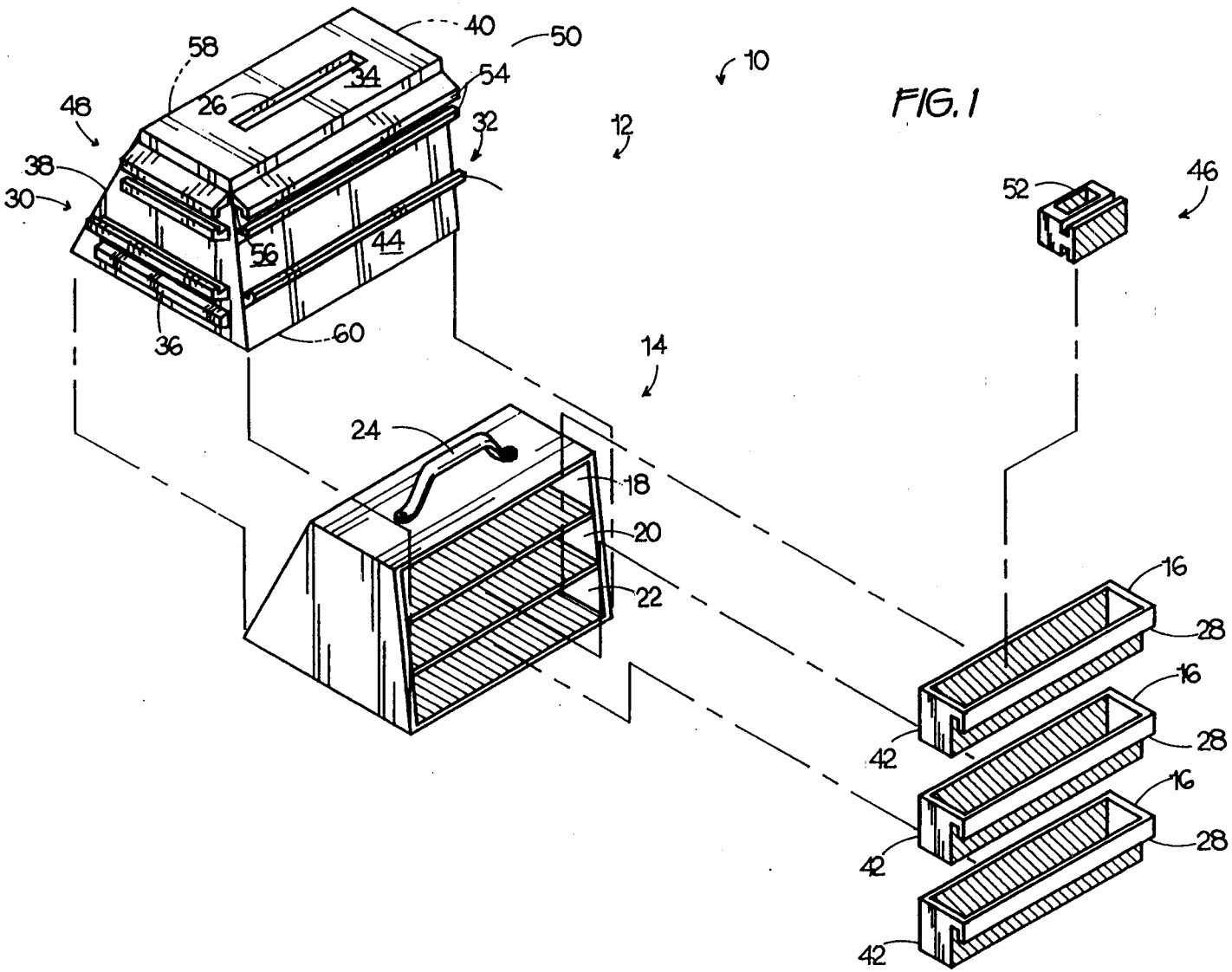
FIG. 1 is an exploded, rear perspective view of a first embodiment of the utility holder of the invention.

Referring to FIG. 1, the present invention is a utility holder 10 having a jacket 12 removably covering a compartmented frame 14. Drawers 16,16,16, which are configured to completely extend into and retract from compartments 18,20,22, respectively, hold tools or other utilities to be stored. When drawers 16,16,16 are retracted into compartments 18,20,22, jacket 12 may be positioned to veil or cover frame 14. In this veiled position, a handle 24 protrudes through an aperture 26, providing a mechanism for carrying utility holder 10, and for shielding drawers 16,16,16 within frame 14. This carrying mechanism does not utilize any fasteners or the like, permitting the quick separation of jacket 12 from frame 14.

Each of the drawers 16,16,16 include an overhanging lip 28,28,28 usable as a hand hold for maneuvering drawers 16,16,16. These overhanging lips 28,28,28 act as attachment mechanisms capable of removably securing to hanging devices 30,32 extending from the exterior 34 of jacket 12. The engagement between lips 28,28,28 and hanging devices 30,32 permits drawers 16,16,16 to be suspended from exterior 34 of jacket 12. In this position, drawers 16,16,16 and their respective contents are readily accessible.

Figure 2:
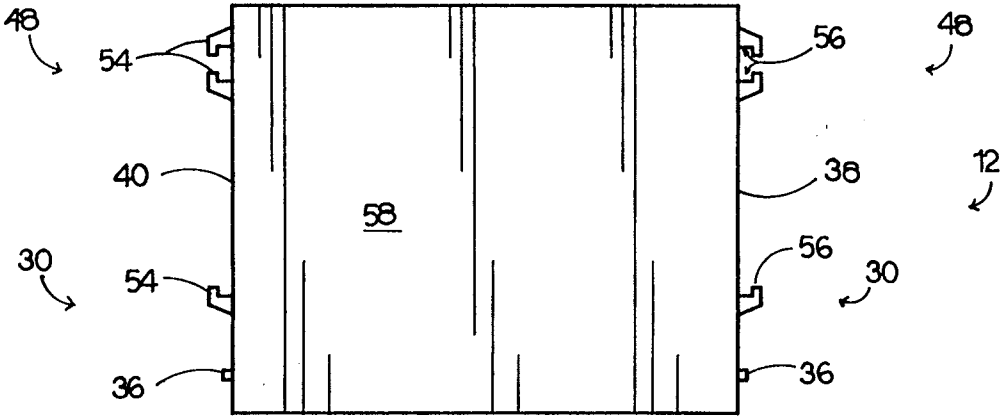
FIG. 2 is a front elevational view of the jacket of the utility holder shown in FIG. 1.

Referring to FIGS. 1 and 2, a pair of spacers 36,36 are positioned upon the surfaces 38,40. These spacers 36,36 are located vertically below the hanging devices 30,30. When one of the lips 28 mates with one of the hanging devices 30 or 32, portion 42 of the suspended drawer 16 engages one of the spacers 36. This prevents the suspended drawer 16 from tilting, as would be the case if portion 42 were permitted to directly engage either surfaces 38 or 40. If the suspended drawer 16 is attached to hanging portion 32, no spacer is necessary because the engagement between portion 42 and angled surface 44 is such that the suspended drawer 16 will not be substantially tilted.

To increase the accessibility of the tools, one or more individual tool holders 46 are suspendable from the hanging devices 48,50. These individual tool holders include a resilient loop 52 and a pair of attachment mechanisms or overhanging lips 28,28. Resilient loop 52 encircles and secures a tool, and overhanging lips 28,28 are removably securable within hanging devices 48,50. When not suspended from hanging devices 48,50, the tool holder 46 fit inside one of the drawers 16 for storage. If desired, drawers 16,16,16 could each hold a plurality of tool holders 46.

The hanging devices 30,32,48,50 are each fabricated from at least one flange 54 extending outward from exterior 34, and bending at an angle to form at least one pocket 56 capable of receiving the overhanging lips 28 of one or more drawers 16 and one or more tool holders 46. Hanging devices 30,32 each have a pocket 56 formed from a flange 54, and hanging devices 48,50 each have opposing pockets 56,56 formed from two flanges 54,54. Although other attachment mechanisms could suffice, the instant arrangement is easy to use, is readily manufactured, and it securely attaches drawers 16,16,16 and tool holder 46 to exterior 34. Additionally, the present arrangement allows for the interchanging of drawers 16,16,16 with one or more different drawers, and tool holder 46 with one or more different tool holders.

Figure 3:
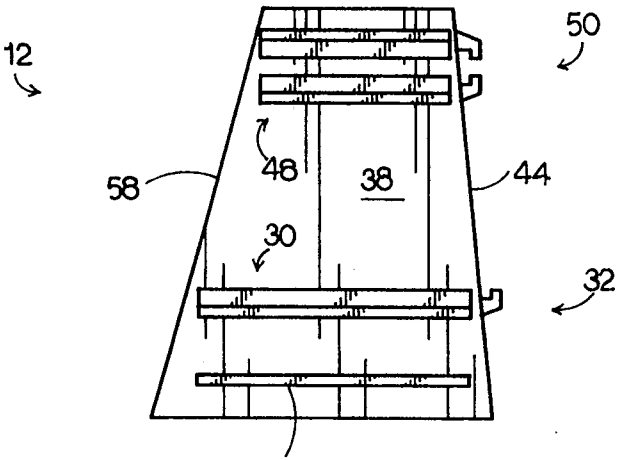
FIG. 3 is a side elevational view of the jacket of the utility holder shown in FIG. 1.
Figure 5:
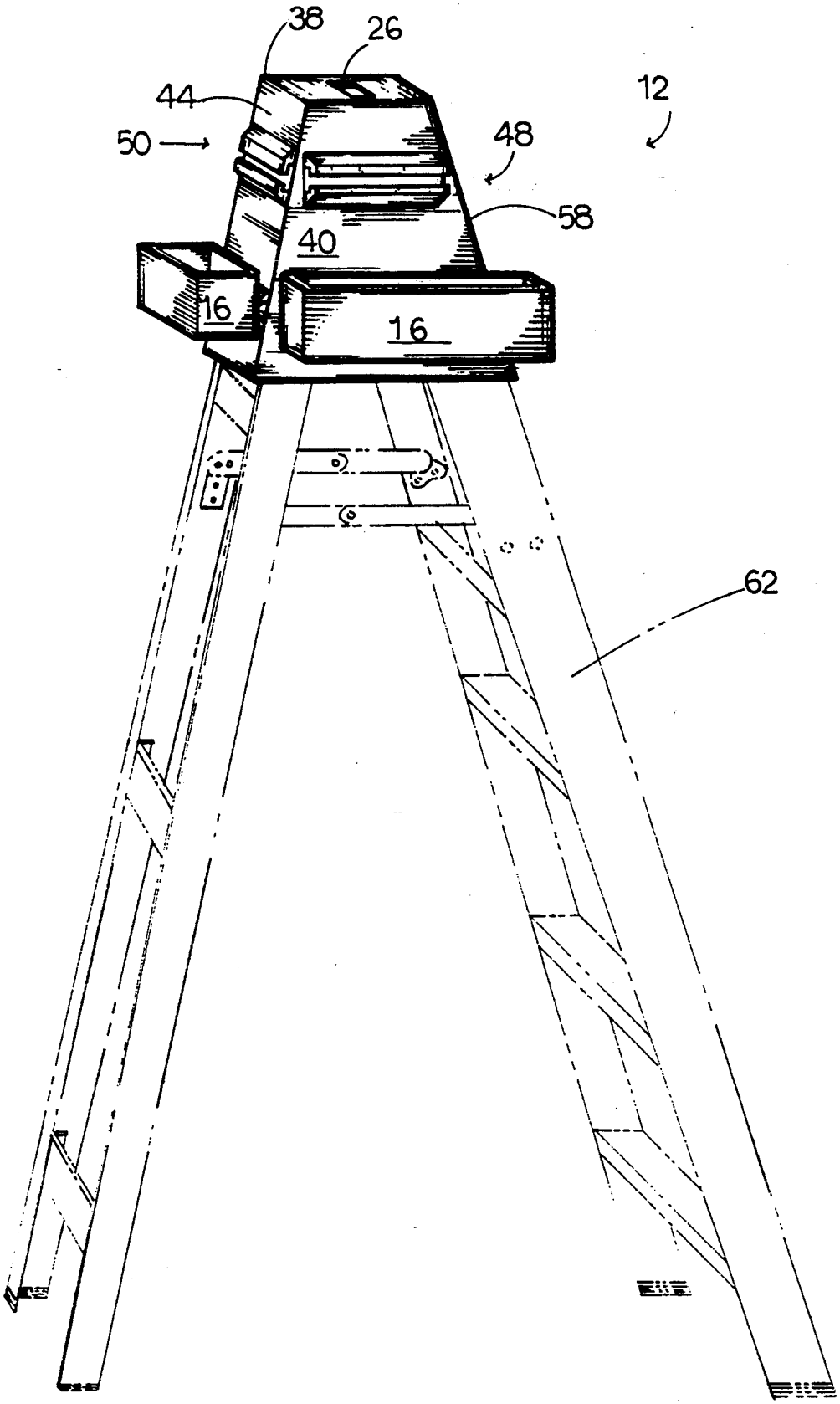
FIG. 5 is an environmental, perspective view of the jacket of the utility holder shown in FIG. 1.

In FIGS. 1 and 3, it can be seen that surface 58 of jacket 12 is angled. As this surface 58 opposes angles surface 44, the side elevational view of jacket 12 appears as a trapezoid. The opposing and angled surfaces 44,58 permit the interior 60 of jacket 12 to conform to the apex of a standard ladder or other device upon which jacket 12 can be placed. In FIG. 5, jacket 12 is illustrated upon the apex of a ladder 62. In this position, jacket 12 and its attached drawers 16,16 are safely secured in an accessible position. The engagement between the apex of ladder 62 and the cavity of the jacket interior 60 eliminates the possibility that jacket 12 can fall to the ground.

Figure 4:
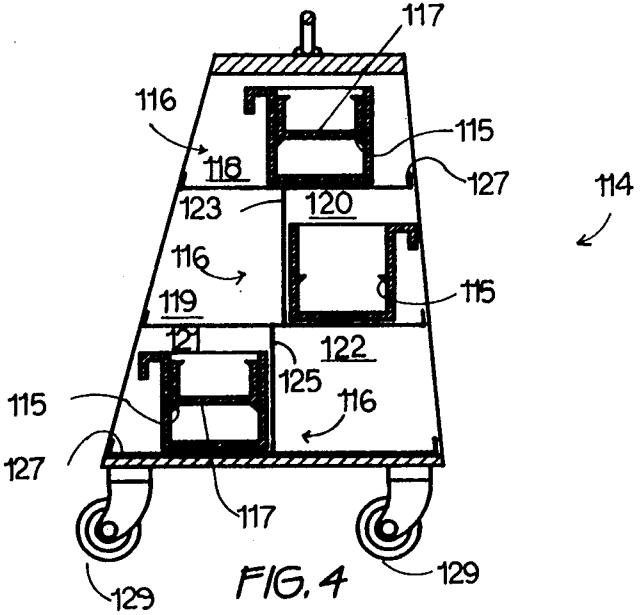
FIG. 4 is a side elevational view in cross section, of a second embodiment of the frame of the invention.
Figure 6:
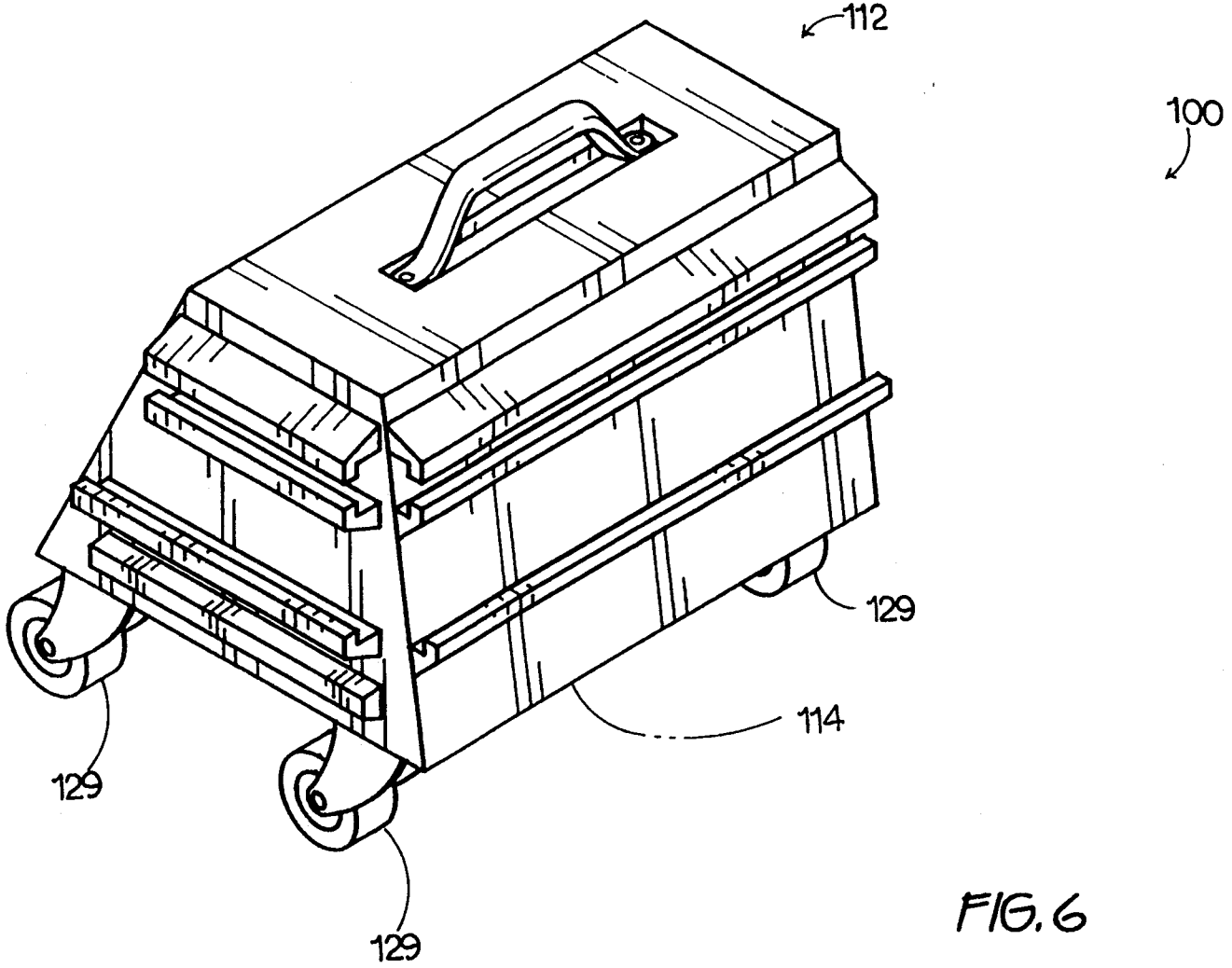
FIG. 6 is a perspective view of the second embodiment of the utility holder of the invention.

In FIG. 4, an alternative embodiment frame 114 includes five compartments 118 through 122, two of which are separated by wall 123, and two of which are separated by wall 125. Drawers 116,116,116 are illustrated to be within compartments 118,120,121. Each of these drawers 116,116,116 includes shelf supports 115, and the drawers within compartments 118,121 each have a removable shelf 117,117 positioned therein. A ridge 127 prevents undesired movement of drawers 116,116,116 within the compartments 118 through 122, and casters 129,129 assist in the transportation of frame 114. In FIG. 6 an alternative embodiment utility holder 100 is shown to include frame 114 covered by jacket 112, similar to jacket 12 of utility holder 10.

Figure 7:
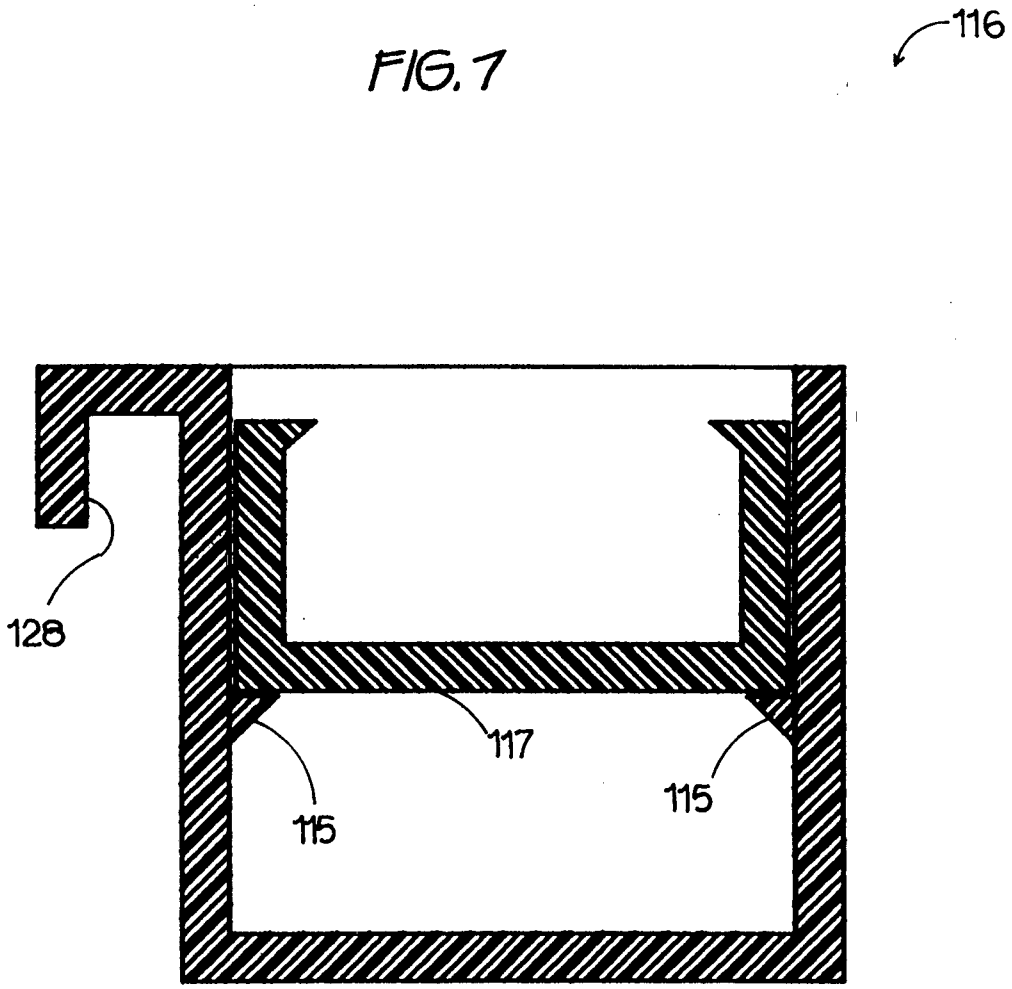
FIG. 7 is a side elevational view in cross section, of a drawer of the invention.
Figure 8:
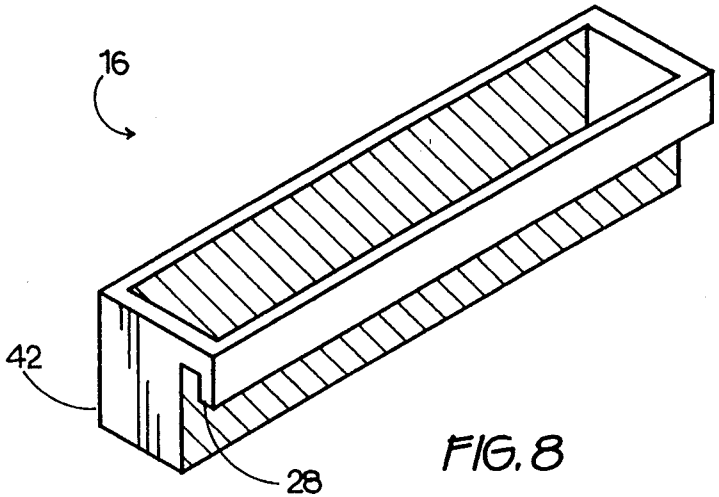
FIG. 8 is a perspective view of an alternative embodiment of the drawer of the invention.
Figure 9:
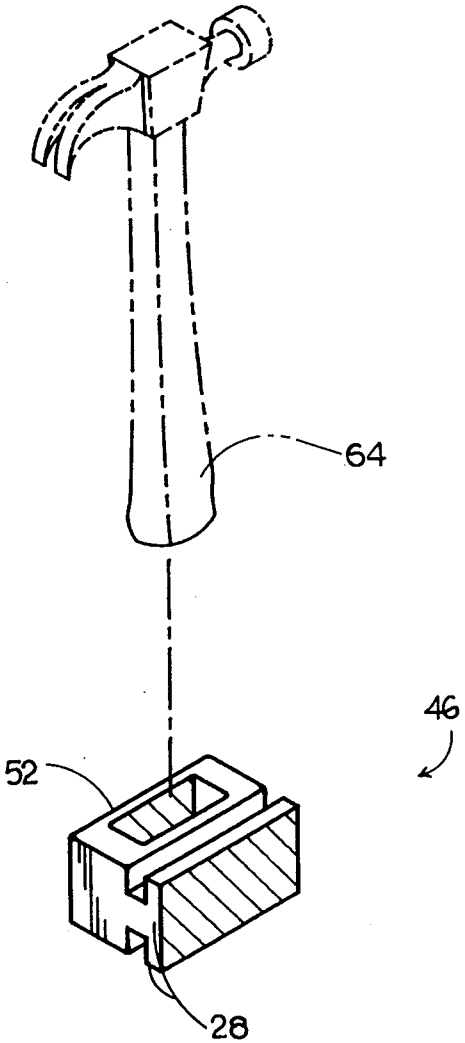
FIG. 9 is a perspective view of a tool holder of the invention.

One advantage of the present invention is that the same storage components, illustrated in FIGS. 7–9, may be utilized with either utility holder 10 or utility holder 100. In FIG. 7, the component illustrated is a drawer 116 having shelf supports 115 and shelf 117. This drawer 116 includes an overhanging lip 128, similar to overhanging lip 28 of component 16, shown independently in FIG. 8. This component or drawer 16 does not include shelf supports and a shelf. Another component is the tool holder 46, illustrated in FIG. 9 to include resilient loop 52 and overhanging lips 28,28. Resilient loop 52 secures a hammer 64 or other tool.

Figure 10:
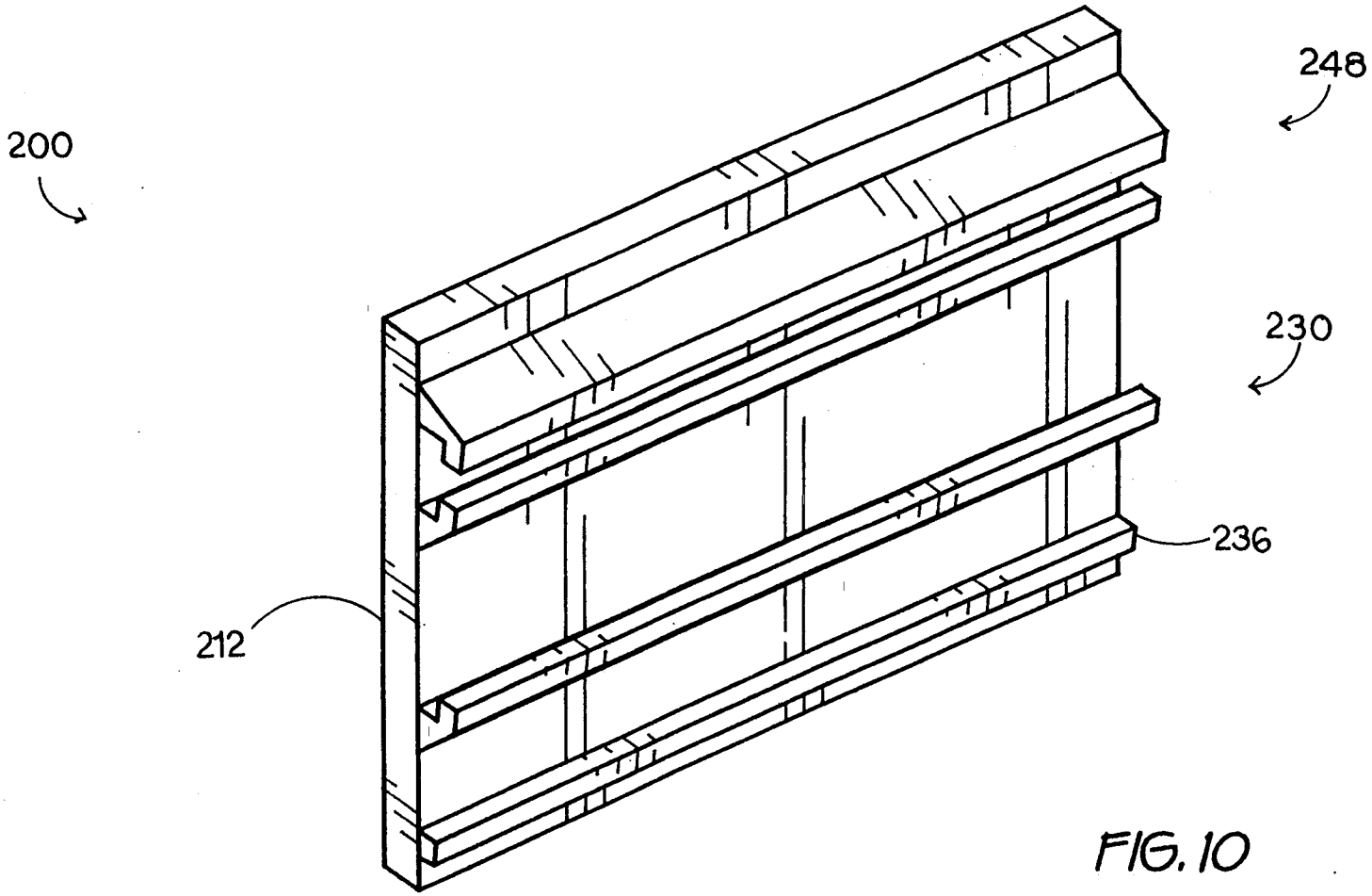
FIG. 10 is a perspective view of a third embodiment of the utility holder of the invention.

Still another alternative embodiment of the invention is illustrated in FIG. 10. The utility holder 200 of this embodiment is a substantially flat plate 212 having a plurality of hanging devices 230,248. The hanging device 230 is for mating with one or more drawers 16,116 (FIGS. 7,8), and the hanging device 248 is for receiving one or more tool holders 46 (FIG. 9). Positioned vertically below hanging device 230 is a spacer 236 for eliminating the tilt of suspended drawers 16,116 (not shown).

Figure 11:
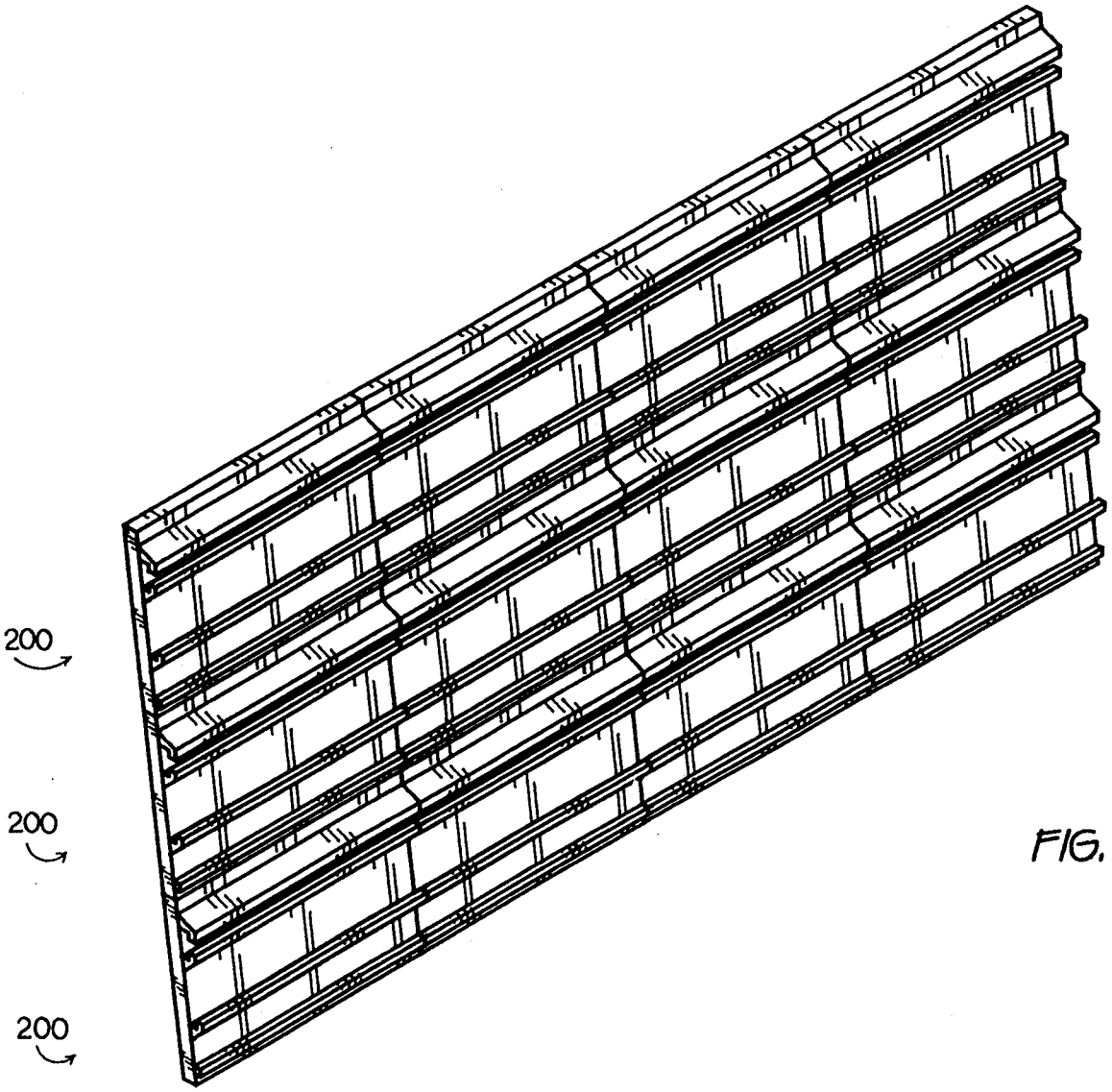
FIG. 11 is a diagrammatic, perspective view of a plurality of utility holders shown in FIG. 10.

Utility holder 200 may be secured to a wall or similar structure, and as depicted in FIG. 11, it may be placed adjacent to a plurality of utility holders 200. This permits for the storage of many drawers 16,116 and tool holders 46 in an easily accessible manner. If desired, drawers 16,116 and tool holders 46 could be utilized interchangeably between utility holders 10, 100 and 200.

It is to be understood that the present invention is not limited to the embodiments described above, but encompasses any and all embodiments within the scope of the following claims.

We claim:

1. A utility holder comprising:

a frame;

a jacket dimensioned and configured to removably cover said frame, said jacket having an interior and an exterior, said interior substantially forming a cavity;

at least one hanging device affixed to said exterior of said jacket; and at least one drawer removable from and retractable into said frame, said at least one drawer having an attachment mechanism removably securable to said at least one handing device.

2. The utility holder according to claim 1, wherein said jacket further comprises means defining an aperture, said frame further comprising a handle protrudable through said aperture when said jacket covers said frame.

3. The utility holder according to claim 2, wherein said jacket further comprises a pair of opposing and angled surfaces.

4. The utility holder according to claim 3, further comprising rotatable caster means for supporting said utility holder.

5. The utility holder according to claim 1, wherein said jacket further comprises means defining an aperture, said frame further comprising a handle protrudable from said aperture when said jacket cover said frame.

6. The utility holder according to claim 1, wherein said jacket further comprises a pair of opposing and angled surfaces.

7. The utility holder according to claim 1, further comprising rotatable caster means for supporting said utility holder.

8. A utility holder comprising:

a frame;

a jacket dimensioned and configured to removably cover said frame, said jacket having an interior and an exterior, said interior substantially forming a cavity;

at least one hanging device affixed to said exterior of said jacket; and at least one tool holder having an attachment mechanism removably securable to said at least one hanging device.

9. The utility holder according to claim 8 wherein said at least one tool holder is dimensioned and configured for placement within said at least one drawer.

10. A utility holder comprising:

a frame having a handle;

a jacket dimensioned and configured to removably cover said frame, said jacket having an interior and an exterior, said interior forming a cavity, said jacket further having means defining an aperture, said handle protruding from said aperture when said jacket covers said frame;

at least one hanging device affixed to said exterior of said jacket;

at least one drawer removable from and retractable into said frame, said at least one drawer having an attachment mechanism removably securable to said at least one hanging device; and at least one tool holder also having an attachment mechanism removably securable to said at least one hanging device.

11. The utility holder according to claim 10 wherein said at least one tool holder is dimensioned and configured for placement within said at least one drawer.

12. The utility holder according to claim 10, said jacket further comprising a pair of opposing and angled surfaces.

13. The utility holder according to claim 10, further comprising rotatable caster means for supporting said utility holder.

* * * * *